US006443318B1

(12) United States Patent
Welsch

(10) Patent No.: US 6,443,318 B1
(45) **Date of Patent: *Sep. 3, 2002**

(54) STRUCTURAL SUPPORT SYSTEM HAVING FREE-STANDING VERTICAL STANDARDS

(75) Inventor: John H. Welsch, Moscow, PA (US)

(73) Assignee: Metro Industries, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/459,475

(22) Filed: Dec. 13, 1999

(51) Int. Cl.[7] ..... A47H 1/08; A47F 5/08

(52) U.S. Cl. ..... 211/90.02; 211/90.04; 211/103; 211/105.3; 211/187

(58) Field of Search ..... 211/90.01, 90.02, 211/90.04, 105.1–105.6, 123, 187, 192, 103; 248/251, 501, 188–188.9; D6/546

(56) References Cited

U.S. PATENT DOCUMENTS

| | | | | | |
|---|---|---|---|---|---|
| 2,991,040 | A | * | 7/1961 | Levy | |
| 3,043,438 | A | * | 7/1962 | Chimielewski | 211/105.6 |
| 3,478,891 | A | * | 11/1969 | Kaeslin | 248/251 |
| 3,538,842 | A | * | 11/1970 | Labbato | 211/123 |
| 3,865,336 | A | * | 2/1975 | Robertson | 248/251 |
| 4,111,309 | A | * | 9/1978 | Henry | 211/105.3 |
| 4,206,955 | A | * | 6/1980 | Cooper | 211/186 |
| 4,209,099 | A | * | 6/1980 | Wickes | 211/182 |
| 4,324,076 | A | * | 4/1982 | Honickman | 211/190 |
| 4,360,109 | A | * | 11/1982 | Kurtz | 211/105.1 |
| 4,372,630 | A | * | 2/1983 | Fuhri | |
| 4,488,651 | A | * | 12/1984 | Bishop | 211/105.6 |
| 4,553,888 | A | * | 11/1985 | Crissy et al. | 248/251 X |
| D301,812 | S | * | 6/1989 | Handler et al. | D6/476 |
| 4,854,456 | A | * | 8/1989 | Lee | 211/123 |
| 5,191,986 | A | * | 3/1993 | Huizenga | 211/87.01 |
| 5,337,905 | A | * | 8/1994 | Gast | 211/105.3 |
| 5,601,016 | A | * | 2/1997 | Witte | 211/94.01 |
| 5,605,238 | A | * | 2/1997 | Jacobs | 211/90.04 |
| 5,702,010 | A | * | 12/1997 | Liang | 211/105.1 |
| 5,803,273 | A | * | 9/1998 | Menaged et al. | 211/87.01 |
| 6,029,833 | A | * | 2/2000 | Yeh | 211/189 |
| 6,079,803 | A | * | 6/2000 | West et al. | 211/90.02 |
| 6,082,560 | A | * | 7/2000 | Timm | 211/90.01 |
| 6,123,033 | A | * | 9/2000 | Polley et al. | 211/90.02 |

* cited by examiner

*Primary Examiner*—Daniel P. Stodola
*Assistant Examiner*—Jennifer E. Novosad
(74) *Attorney, Agent, or Firm*—Fitzpatrick, Cella, Harper & Scinto

(57) ABSTRACT

A structural support system such as a cantilevered shelving system for use in cooperation with a wall that faces an opposing surface includes a standard to which at least one shelf can be mounted. The standard is positionable in a generally upright orientation against the wall so as to support the shelf. A buttress, which is preferably adjustable in length, is positioned to span the distance between a point on the standard and the opposing surface so as to abut both the standard and the opposing surface and brace the standard in the generally upright orientation against the wall.

36 Claims, 4 Drawing Sheets

STRUCTURAL SUPPORT SYSTEM HAVING FREE-STANDING VERTICAL STANDARDS

BACKGROUND OF THE INVENTION

1. Field of the Invention

The present invention relates generally to a structural support assembly that may advantageously be incorporated in a cantilevered shelving system. More particularly, the invention relates to such a shelving system that includes at least one vertical standard supported at its lower end on a base such as a floor and rested against a vertical wall. However, in accordance with the invention the standard does not have to be anchored to the wall.

2. Background of the Invention

One of the simplest and least expensive ways to install shelves on a wall is to use a well-known cantilevered shelving system. In such a system, individual shelves are either mounted directly to shelf-supporting standards or supported on brackets that are mounted on the standards. The standards typically are anchored to the wall by screws, nails, wall anchors, or some other similar fasteners. However, in certain settings, such as some school dormitories or apartments, it may not be permissible to use such fasteners because they can damage the wall. In other settings, such as walk-in coolers with steel or aluminum walls, it may be impractical. Moreover, it can be difficult and time consuming to install such known cantilevered shelving systems in confined spaces like closets and narrow hallways.

Free-standing shelving units, with posts supporting the shelves both in front and in back, are typically utilized where shelving systems having wall-mounted standards are not suitable. Also, the front posts of free-standing shelving units might be considered by some to make the shelves more difficult to access and more bulky in appearance than cantilevered shelves.

Thus, there is a need in the art for a cantilevered shelving system that does not require standards be anchored directly to a wall in a permanent and wall-disfiguring way.

There is further need for such a system that is inexpensive and easy to install.

SUMMARY OF THE INVENTION

The present invention addresses the foregoing needs in the art by providing a shelving system that employs shelf-supporting standards which do not need to be anchored directly to a wall. Rather, the standards are held against the wall by buttresses that compressively span the distance between the wall and an opposing surface like a facing wall.

The inventive shelving system is particularly useful in locations where two opposing walls are separated by a relatively small distance, such as in a closet, hallway or walk-in cooler. The shelves and standards can be located against one wall, with the buttresses spanning the distance to the opposing wall.

Thus, in one aspect, the present invention relates to a shelving system for use against a wall that faces an opposing surface. The shelving system includes a standard to which at least one shelf may be secured. The standard is positionable in a generally upright or vertical orientation against the wall so as to support the shelf when secured subsequently to it. A buttress, which is preferably adjustable in length, is positionable so as to abut both the standard and the opposing surface so as to brace the standard in the generally upright orientation against the wall.

The buttress can be comprised of two pieces that can compressively telescope relative to one another between an extended position and a contracted position. A suitable mechanism can be provided for fixing the pieces relative to one another when in their extended position. Alternatively, the pieces can be biased, for example by a spring, into the extended position so as to clamp the standard against the wall when the buttress is compressed between the standard and the opposing surface.

The buttress can be selectively detachable from the standard. Such a buttress can include a projection at an end, and the standard can include an orifice into which the projection may be inserted. The end of the buttress at which the projection is disposed can be compressible toward an opposite end of the buttress to facilitate attachment and detachment of the buttress relative to the standard, and that end of the buttress also can be biased away from the opposite end to urge the standard against the wall.

A foot extension can be provided to be mounted at a base of the standard so as to extend below that base support and elevate the standard. The foot extension can be formed to be spaced from the plane of the wall when secured to the standard so as to accommodate, for example, a decorative baseboard running along the bottom of the wall.

In another aspect, the present invention relates to a shelving system for use against a wall that faces an opposing surface. The shelving system includes a generally upright or vertical standard to which at least one shelf may be secured. The standard is positioned against the wall so as to support the shelf when the shelf is secured to it. A buttress extends between the upright standard and an opposing surface that the wall faces. The buttress is adjustable in length so as to abut the standard and the opposing surface so as to urge the standard against the wall.

In yet another aspect, the present invention relates to a method of assembling a shelving system on a wall that faces an opposing surface. The method includes positioning a standard, on which at least one shelf may be mounted, in a generally upright orientation against the wall. A buttress is positioned so as to be compressed between the standard and the opposing surface so as to urge the standard against the wall. Preferably, the buttress is adjusted so that it will tightly fit between the standard and the opposing surface. The shelf can then be mounted on the standard.

These and other objects, features and advantages of the present invention will be more apparent from the following detailed description, with reference to the accompanying drawings, in which like reference numerals indicate like elements throughout.

DETAILED DESCRIPTION OF THE PREFERRED EMBODIMENTS

Figure 1:
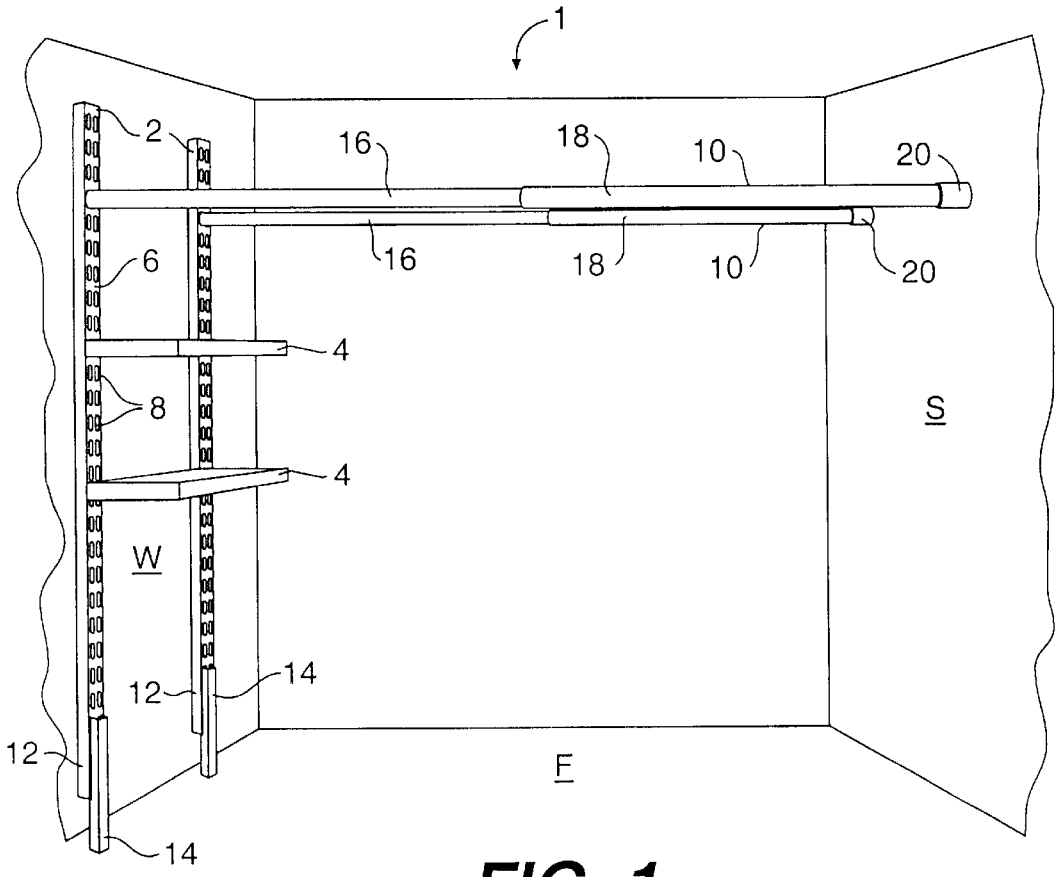
FIG. 1 is a schematic elevational view of an assembled cantilevered shelving system according to a preferred embodiment of my invention.

As shown in FIG. 1, a preferred embodiment of the structural support system 1 of the present invention includes at least one generally upright standard 2 that may be positioned to rest against a wall W and is configured to support at least one element, such as a shelf 4, in cantilevered fashion. In most cases, as in the illustrated embodiment, a pair of parallel standards 2 can be positioned to support a plurality of shelves 4 each at opposing lateral sides. The structure of the standards 2 and the manner in which the standards 2 support the shelves 4 can be conventional, and any of a number of known designs can be employed, as will be discussed below.

However, unlike conventional cantilevered shelving systems, advantageously in accordance with the present invention the standards need not be anchored or otherwise directly secured to the wall with fasteners like nails or screws. Therefore, the wall is not damaged or otherwise disfigured. Nevertheless, the basic components of the shelving system itself, which may be like those known in the art, will be described first.

Each shelf-support standard 2 of the embodiment illustrated in FIG. 1 can be a generally rectangular U-shaped member, a face 6 of which is formed with a series of vertical slots 8. The shelves 4 can be mounted to the standards 2 by conventional upper and lower tabs (not shown), the upper of which has an inverted L-shape, which fit into the slots 8 provided in the standards.

Each standard 2 is supported vertically at its base 12, in some instances simply by resting on a supporting base like a floor F or other rigid support surface. In some cases, discussed below, a separate foot extension 14 can be employed to support the base 12 of the standard 2 on the floor F.

As noted, the standards 2 are not anchored directly to the wall W. Rather, each standard 2 is braced or urged against the wall W by a buttress 10 that extends between the standard 2 and an opposing surface S that faces the wall. For example, the surface S may be an opposing wall in a closet or a hallway.

Preferably, each buttress 10 is adjustable in length. This permits the shelving system to be used in various locations. Each buttress 10 also preferably includes a mechanism whereby its length can be positively expanded to compressively clamp or urge the standard 2 against the wall.

Figure 1A:
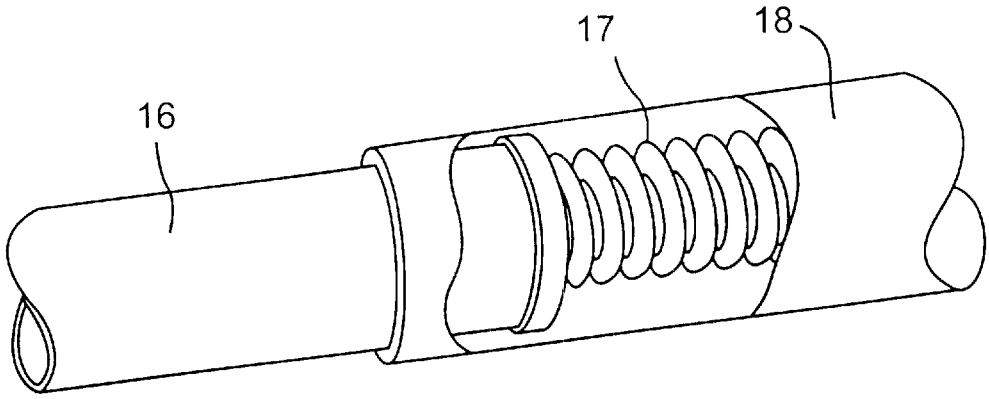
FIG. 1A is a partial cut-away, detailed view of an engagement between telescoping rods in an embodiment of the shelving system illustrated in FIG. 1.
Figure 1B:
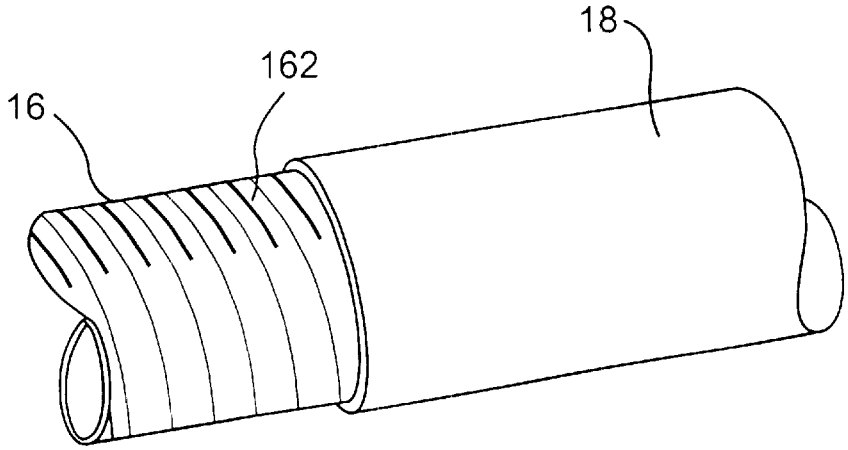
FIG. 1B is a partial cut-away, detailed view of an engagement between an alternate embodiment of the telescoping rods.

In the preferred embodiment, each buttress 10 is comprised of two telescoping cross-pieces, such as a pair of nested cylindrical rods 16, 18. The length of the buttress 10 is adjusted generally by telescoping the rods 16, 18 axially relative to one another. The telescoping rods 16, 18 are spring-loaded (such as by an internal coil spring 17 in FIG. 1A) so that the spring force tends to elongate the buttress. Such mechanisms are well-known for use in, as an example, shower-curtain rods. Alternatively, as shown in FIG. 1B the rods may be provided with an internal screw mechanism wherein one rod 18 is provided with a threaded nut-like element (not shown) and the other rod 16 with a mating threaded screw 16*a,* such that rotation of one rod relative to the other causes their collective length to increase or decrease. Any other mechanism for positively expanding the length of each buttress may also be employed.

In use, the length of buttress 10 shown in FIG. 1 can be reduced by compressing the internal spring or rotating one rod relative to the other if a screw mechanism is employed to a contracted position so that the buttress can span the distance between the standard 2 and the opposing surface S. Once in position, the buttress 10 can then be permitted or manipulated to expand its length to an extended position so as to clamp or brace the standard 2 against the wall W.

An end cap 20 can be provided at one end of the buttress to cushion it against the surface S and enhance the friction between the two. The other end of the buttress 10 is preferably provided with a structure to detachably secure it to the standard 2. As an example a projection can be provided for insertion into a corresponding slot of the standard 2, which helps to stabilize the shelving system 1 when assembled. More particularly, the projection can be configured to fit into one of the slots 8 provided for the shelf tabs, which permits the height of the buttress 10 to be adjusted up and down the standard 2 as desired. Alternatively, a separate opening or series of openings can be provided at the desired height or heights, specifically for receipt of the projection.

Figure 2:
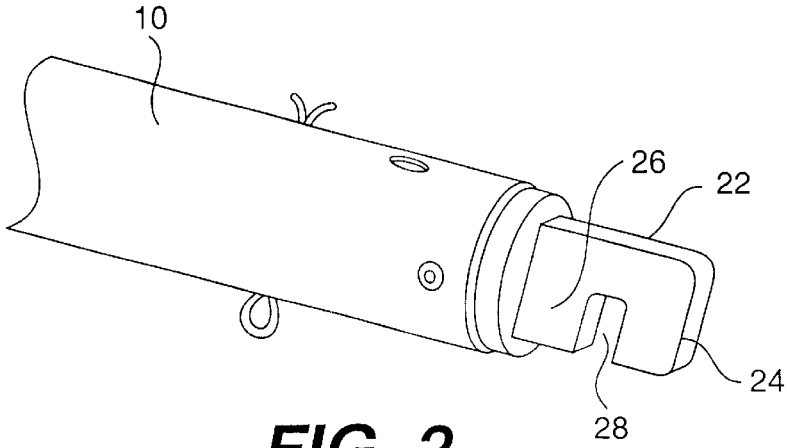
FIG. 2 is a detailed perspective view of an end of a buttress of the shelving system illustrated in FIG. 1.

A preferred embodiment of this projection 22 is illustrated in FIG. 2. As shown there it is C-shaped, with a leading tab 24 and a base 26, separated by a notch 28. The leading tab 24 fits into a slot 8 provided in the standard 2, and the notch 28 fits down over the bottom edge of the slot 8, thereby securing the buttress 10 to the standard 2. The base 26 of the projection 22 can then press against the face 6 of the standard 2 to brace the standard 2 against the wall W.

While the standards 2 are not anchored to the wall W. sideward movement of them is resisted by friction between them and the wall, if the buttresses 10 clamp the standards 2 against the wall W with sufficient force. When integrated shelf and shelf supporting brackets are mounted on parallel standards 2 as shown in FIG. 1, added stability results because the shelves act as cross-beams between the parallel standards. This effect can be increased by utilizing double-slotted standards, well known in the art for heavier-duty applications, and complementary dual tabs on the shelves or brackets, to provide a more rigid structure mounting. Additionally, a friction-enhancing surface or coating can be provided on the backsides of the standards 2 opposite the slotted sides.

The buttresses 10 can be located at any height above the bases 12 of the standards 2 as long as they sufficiently tightly brace the standards 2 against the wall W once the shelves 4 are in place and loaded. Preferably, the buttresses 10 are located high enough to be out of the way of the shelves 4. If the shelving system 1 is to be used in a hallway or in a walk-in closet or cooler, it is also preferred that the standards 2 be tall enough and the buttresses 10 located high enough to provide adequate head clearance. The buttress 10 can also be positioned at a suitable height for hanging clothes. In such an application, it may be desirable to provide additional vertical support for the buttress at the opposing wall. For example, an opposing standard, such as the standards 2, can be used.

Figure 2A:
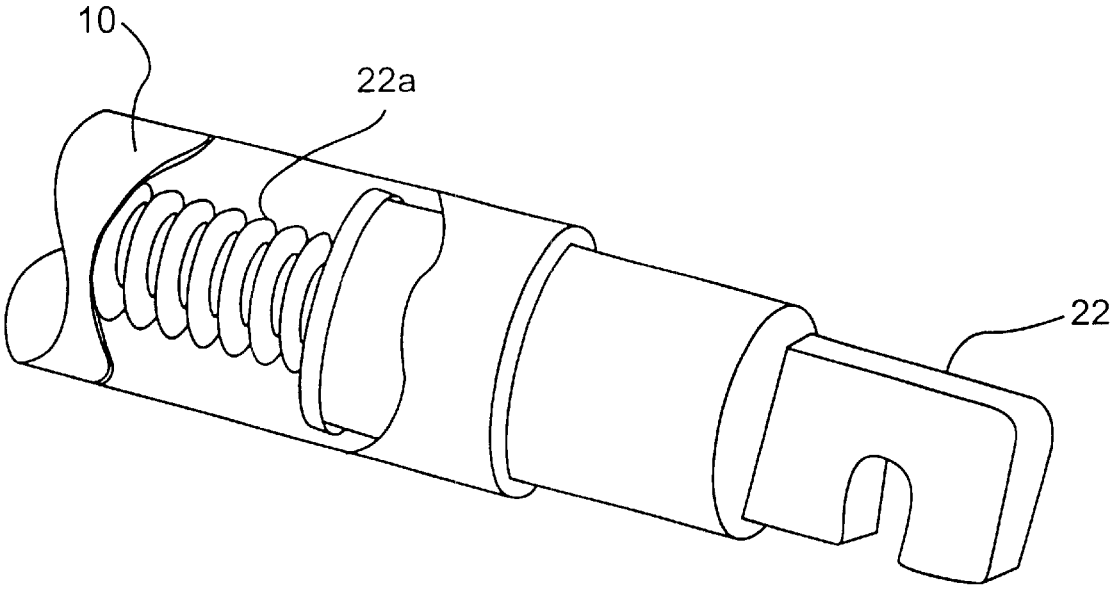
FIG. 2A is a partial cut-away illustrating an end of an alternate embodiment of the buttress illustrated in FIG. 2.

It should be noted that, in accordance with the invention, it is not required that the cross-pieces of each buttress be provided with a spring bias or screw mechanism to compressively expand its length. Rather, the buttress can simply be adjustable to a fixed length, in any of the manners described above, or otherwise. In such an arrangement, the projection 22 can be mounted for compression into the end of the buttress 10, for example by being mounted on a coil spring 22*a,* as shown in FIG. 2A. This arrangement facilitates positioning of the buttress 10 between the standard 2 and the surface S that faces the wall W once the length of the buttress 10 is selected. Of course, the projection 22 can be biased to its extended position by means other than a spring. Alternatively, the length of the buttress can be set to slightly exceed the distance between the standard and the surface that faces the wall, and the buttress can then be wedged into place between the standard 2 and the facing surface S.

In another alternative, the buttress can be a unitary, flexible bar that is bowed to fit between the standard 2 and the facing surface S. The resiliency of the buttress itself provides the desired clamping force.

It should also be noted that the projection 22 need not be provided at the end of the buttress 10. In a simple alternative configuration, the end of the buttress 10 can simply clamp against the front surface of the standard 2. A friction-enhancing end cap or pad (not shown) can be provided on the buttress or the standard to reduce the likelihood that the buttress will slip laterally relative to the standard. Alternately, the end of the buttress, the face of the standard, or both, can be shaped in any of innumerable manners to complement one another, so as to promote a secure abutment between them.

Each buttress is preferably formed so as to withstand the compressive forces created by the tendency of the standards and the loaded shelves to pivot away from the wall. Therefore, the materials selected and the dimensions of the buttress can vary depending upon the intended use of the shelving system 1. Metals, such as various grades of steel and aluminum, as well as some plastics and fiberglass, which are typically used in shelving applications, are generally suitable for most applications.

The principles of the present invention apply to cantilevered shelving systems that are configured differently. For example, the shelves can be cantilevered to a single standard, rather than a pair of standards. Similarly, more than two standards can be used to support a set of shelves. The standards can include single or multiple sets of slots for supporting the shelves, or for supporting brackets on which the shelves are supported. Also, tension lines can be fixed to the standards for suspending the shelves from above. All of these arrangements are well-known in the art. In another alternative, the buttresses can extend between opposing sets of standards resting against opposing walls, so that shelves can be installed on both of those opposing walls.

In each case, the standards, shelves and brackets can be formed of materials that are also well-known for use in cantilevered shelving systems. For example, steel, aluminum, other suitable metals, various types of wood, as well as plastics, fiberglass and other synthetic materials can be used.

When the shelving system 1 is assembled, the standards should lie flat against the wall W. This arrangement helps to maintain the stability of the shelving system 1 when the shelves 4 are in place. This also permits the shelving system 1 to utilize many common shelves and/or brackets, which are designed to be supported by vertical standards. However, many walls have baseboards, shoe molding, or like surface features at their bases, and thus are not flat all the way to the floor. In order to permit the standards 2 to lie flat against the wall W while resting on the floor F, the standards 2 can be shaped to fit around the surface features at the base of the wall W. Alternatively, however, a separate foot extension 14 can be provided. The foot extension 14 elevates the base 12 of the standard 2 and is spaced from the plane of the wall W, thereby avoiding the surface features at the base of the wall W. The configuration of the foot extension 14 can vary and is dictated largely by the configuration of the standards 2.

Figure 3:
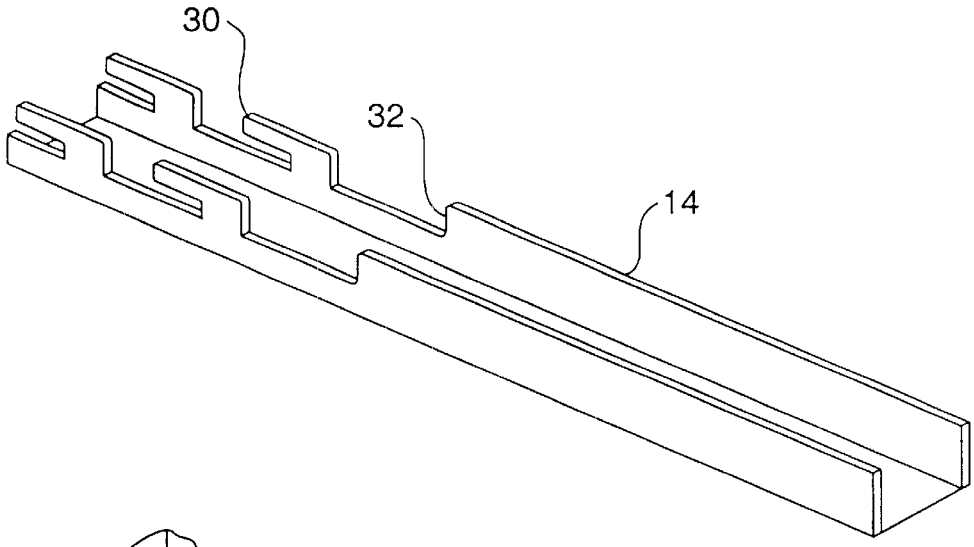
FIG. 3 is a detailed perspective view of a foot extension for an upright standard of the shelving system illustrated in FIG. 1.
Figure 4:
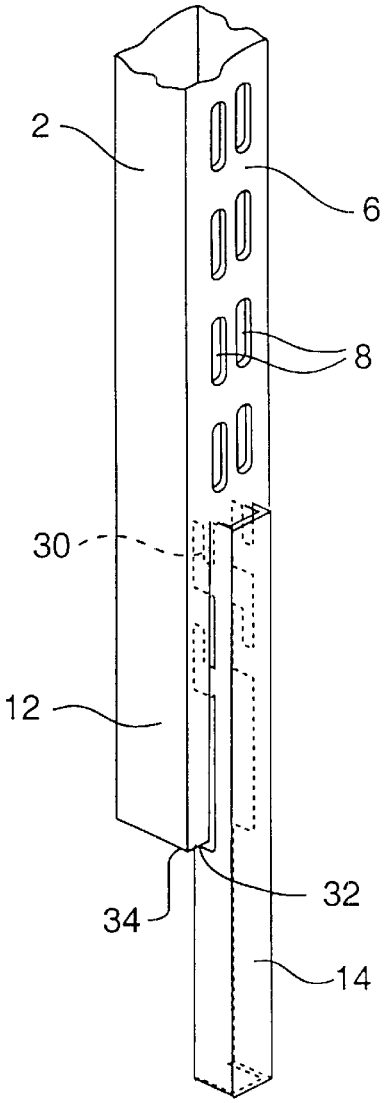
FIG. 4 is a detailed schematic view of the engagement between the foot extension and the standard of the shelving system illustrated in FIG. 1.

In the preferred embodiment, however, the foot extension 14 can be secured to the standard in a similar manner to the shelves 2 or brackets, except that the engagement should be designed so that the foot extension 14 bears the weight of the standard 2, rather than the converse. In this embodiment, illustrated in FIGS. 3 and 4, the foot extension 14 includes L-shaped tabs 30 that fit into the shelf-support slots 8 near the base 12 of the standard 2. The tabs 30 of the foot extension 14 are oriented in a manner opposite that of the tabs of the shelves 4, because the foot extension 14 will bear the weight of the standard 2. A seat 32 is also provided, on which the bottom edge 34 of the standard 2 can rest.

As noted, the configuration of the foot extension 14 can be varied. For example, the foot extension 14 can be configured so that the height at which it is attached to the standard 2 can be adjusted, in a similar manner to the shelves or brackets. This can be done by, for example, eliminating the seat 32 on which the bottom edge 34 of the standard rests 2. Additional tabs 30 can be employed to change the distribution of the load, as necessary. This height adjustability can be used both to accommodate varying wall-base surface features and to provide a mechanism for adjusting the overall height of the shelving system 1. Alternatively, a conventional threaded leveling foot (not shown) can be utilized at the bottom of the foot extension 14 to provide height adjustability, as well as a mechanism for leveling the shelves.

As another example, the foot extension 14 can be configured as a sleeve, into which the base of the standard fits, with a bottom on which the bottom edge of the standard sits and a weight-supporting leg extending from the bottom of the sleeve. Also, larger, horizontally extended foot extensions can be provided for use where there are larger obstacles at the base of the wall, such as baseboard heating elements.

It will be appreciated that in many applications the shelving system in accordance with the present invention provides significant advantages over conventional cantilevered shelving systems that employ standards permanently anchored to a wall with known fasteners. The system of the invention can be used with particular benefit in hallways and closets and in applications like steel or aluminum coolers where breaching the integrity of a wall is undesirable. In addition, the inventive shelving system can be easily assembled and erected by one person.

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

What is claimed is:

1. A structural support system for use in cooperation with a wall that faces an opposing surface, the structural support system comprising:

a standard capable of receiving a mounted element, the standard being positioned in a generally upright orientation and being supported from below by a supporting surface so that the standard rests freely against the wall so as to support the element when mounted thereon; and a buttress mounted to span the distance between a point on the standard and the opposing surface and to abut both the point on the standard and the opposing surface, with the buttress including an urging mechanism urging the standard against the wall to thereby hold the standard against the wall.

2. The structural support system of claim 1, wherein the urging mechanism includes means for adjusting its length.

3. The structural support system of claim 1, wherein the buttress comprises two cross-pieces assembled in telescoping relation for movement between an extended position and a retracted position.

4. The structural support system of claim 3, wherein the buttress comprises means for fixing the cross-pieces relative to one another.

5. The structural support system of claim 3, wherein the urging mechanism includes a spring for biasing the cross-pieces toward the extended position for urging the standard against the wall when the buttress abuts both the standard and the opposing surface.

6. The structural support system of claim 3 wherein said buttress comprises screw means for moving the cross-pieces between the extended and retracted positions.

7. The structural support system of claim 1, wherein the buttress comprises means for attaching it to the standard.

8. The structural support system of claim 7, wherein the means for attaching includes a projection at an end of the buttress, and an orifice in the standard into which the projection may be inserted.

9. The structural support system of claim 8, wherein the projection is mounted in the buttress for movement between the extended and retracted positions, and wherein the urging mechanism includes a spring for biasing the projection to the extended position thereby to facilitate engagement of the buttress to the standard.

10. The structural support system of claim 1, wherein the standard has a base and said system further comprises a foot extension mountable on the base thereby elevating the standard, the foot extension being formed to be spaced from a plane of the wall when mounted on the standard and when the standard rests against the wall.

11. The structural support system of claim 1, further comprising friction enhancing means for enhancing the friction between the standard and the wall.

12. The structural support system of claim 1, wherein the standard includes a bottom end configured to rest on a base when the standard is positioned in the generally upright orientation and wherein the point on the standard abutted by the buttress is remote from the bottom end.

13. The structural support system of claim 1, further comprising a second standard positionable in a generally upright orientation resting against the opposing surface, and wherein the buttress is mountable to span the distance between a point on the standard and a point on the second standard and to abut both the point on the standard and the point on the second standard, thereby to urge the standard against the wall and the second standard against the opposing surface.

14. A structural support system for use in cooperation with a wall that faces an opposing surface, the structural support system comprising:

a generally upright standard capable of receiving a mounted element, the standard being supported from below by a supporting surface and being positioned to rest freely against the wall so as to support the element when mounted thereon; and a buttress spanning the distance between the standard and the opposing surface, the buttress including urging means for varying its length so as to compressively abut a point on the standard and the opposing surface thereby urging the standard against the wall to thereby hold the standard against the wall.

15. The structural support system of claim 14, wherein the buttress comprises two cross-pieces assembled in telescoping relation for movement between an extended position and a retracted position.

16. The shelving system of claim 15, wherein the buttress comprises means for fixing the cross-pieces relative to one another.

17. The structural support system of claim 15, wherein the urging means includes a spring for biasing the cross-pieces toward the extended position so as to urge the standard against the wall when the buttress abuts both the standard and the opposing surface.

18. The structural support system of claim 15, wherein said urging means includes screw means for moving the cross-pieces between the extended and retracted positions.

19. The structural support system of claim 15, wherein said standard comprises friction enhancing means for enhancing the friction between the standard and the wall.

20. The structural support system of claim 14, wherein the buttress comprises means for attaching it to the standard.

21. The structural support system of claim 20, wherein the buttress includes a projection at an end thereof, and the standard includes an orifice into which the projection may be inserted.

22. The structural support system of claim 21, wherein the projection is mounted in the buttress for movement between the extended and retracted positions, and wherein the urging means includes a spring for biasing the projection to the extended position thereby facilitating engagement of the buttress to the standard.

23. The structural support system of claim 14, wherein the standard has a base and said system further comprises a foot extension mountable on the base thereby elevating the standard, the foot extension being formed to be spaced from a plane of the wall when mounted on the standard and when the standard rests against the wall.

24. The structural support system of claim 14, wherein the standard includes a bottom end configured to rest on a base when the standard is positioned in the generally upright orientation and wherein the point on the standard that is abutted by the buttress is remote from the bottom end.

25. The structural support system of claim 14, further comprising a second generally upright standard positioned to rest against the opposing surface, wherein the buttress spans the distance between a point on the standard and a point on the second standard, and wherein the means for varying the buttress length causes the buttress to compressively abut the point on the standard and a point on the second standard, thereby urging the standard against the wall and the second standard against the opposing surface.

26. A method of assembling a structural support system in cooperation with a wall that faces an opposing surface, the method comprising the steps of:

positioning a standard, capable of receiving a mounted element thereon, in a generally upright orientation so that the standard is supported from below on a supporting surface and is freely resting against the wall;

mounting a buttress to span the distance between a point on the standard and the opposing surface thereby abutting both the point on the standard and the opposing surface; and providing the buttress with an urging force for urging the standard against the wall to thereby hold the standard against the wall.

27. The method of claim 26, further comprising the step of adjusting a longitudinal length of the buttress so that it will fit tightly between the standard and the opposing surface.

28. The method of claim 27, wherein the buttress comprises two cross-pieces assembled in telescoping relation for movement between an extended position and a retracted position, and wherein the step of adjusting the length comprises moving the two cross-pieces to an adjusted position between the extended and retracted position.

29. The method of claim 28, further comprising the step of fixing the cross-pieces in the adjusted position.

30. The method of claim 27, further comprising the step of providing a spring within the buttress for biasing the cross-pieces towards the extended position, wherein the step of adjusting the length includes compressing the cross-pieces towards the retracted position, and wherein the mounting step includes orienting the buttress with the cross-pieces compressed and, once the buttress is oriented, releasing the cross-pieces to permit them to move toward their extended position so as to urge the standard against the wall.

31. The method of claim 26, further comprising the step of providing the buttress with a projection at an end thereof, the standard is formed with an orifice into which the projection may be inserted, and the mounting step includes inserting the projection into the orifice.

32. The method of claim 31, wherein the buttress further includes means for moving the projection between extended and retracted positions, means for biasing the projection toward the extended position, and wherein the mounting step further includes depressing the projection toward the retracted position to facilitate orienting the buttress and, once the buttress is properly oriented and the projection is inserted in the orifice, releasing the projection to permit it to move to its extended position thereby urging the standard against the wall.

33. The method of claim 26, further comprising the step of, prior to the positioning step, securing a foot extension to a base of the standard so as to extend below the base of the standard, and wherein the positioning step includes orienting the standard so that the foot extension supports and elevates the standard, wherein the foot extension is spaced from a plane of the wall when supporting and elevating the standard.

34. The method of claim 26, wherein the standard has a bottom end and wherein the point on the standard is remote from the bottom end.

35. The method of claim 26, further comprising the step of positioning a second standard in a generally upright orientation against the opposing surface, and wherein said mounting step comprises mounting the buttress to span the distance between the point on the standard and a point on the second standard, thereby abutting both the point on the standard and the point on the opposing standard and to urge the standard against the wall and the second standard against the opposing surface.

36. A shelving system for use in cooperation with a wall that faces an opposing surface, the shelving system comprising:

support means positioned against the wall for supporting at least one shelf, said support means being supported from below by a supporting surface and freely resting against the wall; and brace means extending between the support means and the opposing surface and providing an urging force to brace the support means against the wall to thereby hold the standard against the wall.

* * * * *

UNITED STATES PATENT AND TRADEMARK OFFICE

CERTIFICATE OF CORRECTION

PATENT NO. : 6,443,318 B1
DATED : September 3, 2002
INVENTOR(S) : John H. Welsch It is certified that error appears in the above-identified patent and that said Letters Patent is hereby corrected as shown below:

Column 8,
Line 12, “shelving” should read -- structural support --.

Signed and Sealed this

Twenty-ninth Day of April, 2003

JAMES E. ROGAN
*Director of the United States Patent and Trademark Office*